US010222112B2

(12) United States Patent
Gaplikow et al.

(10) Patent No.: US 10,222,112 B2
(45) Date of Patent: Mar. 5, 2019

(54) REFRIGERATION DEVICE HAVING AN ICE MAKER

(71) Applicant: BSH HAUSGERAETE GMBH, Munich (DE)

(72) Inventors: Eugen Gaplikow, Guenzburg (DE); Roland Kuemmel, Nellingen (DE); Mathias Sigl, Herbrechtingen (DE); Rainer Spaag, Ellwangen-Roehlingen (DE)

(73) Assignee: BSH Hausgeraete GmbH, Munich (DE)

( * ) Notice: Subject to any disclaimer, the term of this patent is extended or adjusted under 35 U.S.C. 154(b) by 143 days.

(21) Appl. No.: 14/651,334

(22) PCT Filed: Nov. 29, 2013

(86) PCT No.: PCT/EP2013/075136
§ 371 (c)(1),
(2) Date: Jun. 11, 2015

(87) PCT Pub. No.: WO2014/090608
PCT Pub. Date: Jun. 19, 2014

(65) Prior Publication Data

US 2015/0300717 A1 Oct. 22, 2015

(30) Foreign Application Priority Data

Dec. 12, 2012 (DE) ..... 10 2012 222 861

(51) Int. Cl.
*F25C 1/25* (2018.01)
*F25C 5/20* (2018.01)

(52) U.S. Cl.
CPC ..... *F25C 5/22* (2018.01); *F25C 1/25* (2018.01); *F25C 2400/14* (2013.01); *F25C 2500/08* (2013.01); *F25D 2400/02* (2013.01)

(58) Field of Classification Search
CPC ..... F25C 1/225; F25C 1/24; F25C 2400/14
See application file for complete search history.

(56) References Cited

U.S. PATENT DOCUMENTS 2,299,103 A 10/1942 Miller et al.
3,012,417 A 12/1961 Harle
(Continued)

FOREIGN PATENT DOCUMENTS

CN 202166248 U 3/2012
DE 102010039562 A1 2/2012
(Continued)

OTHER PUBLICATIONS

Machine Translation of Description of CN202166248—retreived Dec. 2016.*
(Continued)

*Primary Examiner* — Orlando E Aviles
(74) *Attorney, Agent, or Firm* — Laurence A. Greenberg; Werner H. Stemer; Ralph E. Locher

(57) ABSTRACT

A refrigeration device includes a water supply device for supplying water to an ice maker in the interior of the refrigeration device. The refrigeration device has an installation recess in an inner wall of the refrigeration device for inserting the water supply device. The installation recess is closed towards an outer wall of the refrigeration device.

13 Claims, 5 Drawing Sheets

(56) References Cited

U.S. PATENT DOCUMENTS

| | | | | | |
|---|---|---|---|---|---|
| 3,411,554 | A | | 11/1968 | Wilson | |
| 4,020,644 | A | | 5/1977 | True, Jr. et al. | |
| 4,822,117 | A | * | 4/1989 | Boston, Jr. | F25D 23/062 29/455.1 |
| 6,082,780 | A | | 7/2000 | Rowley et al. | |
| 6,148,624 | A | * | 11/2000 | Bishop | F25C 5/185 62/344 |
| 6,157,777 | A | * | 12/2000 | Banks | F24H 1/142 219/536 |
| 2008/0110924 | A1 | * | 5/2008 | Fueki | G01F 11/021 222/1 |
| 2012/0031138 | A1 | * | 2/2012 | Hunter | F25C 1/225 62/347 |

FOREIGN PATENT DOCUMENTS

| | | | |
|---|---|---|---|
| DE | 102011006860 | A1 | 10/2012 |
| FR | 2927162 | A1 | 8/2009 |
| WO | 02052207 | A1 | 7/2002 |
| WO | 2012022644 | A2 | 2/2012 |
| WO | 2012136557 | A2 | 10/2012 |

OTHER PUBLICATIONS

Machine Translation of Description of DE102010039562—retreived Dec. 2016.*

* cited by examiner

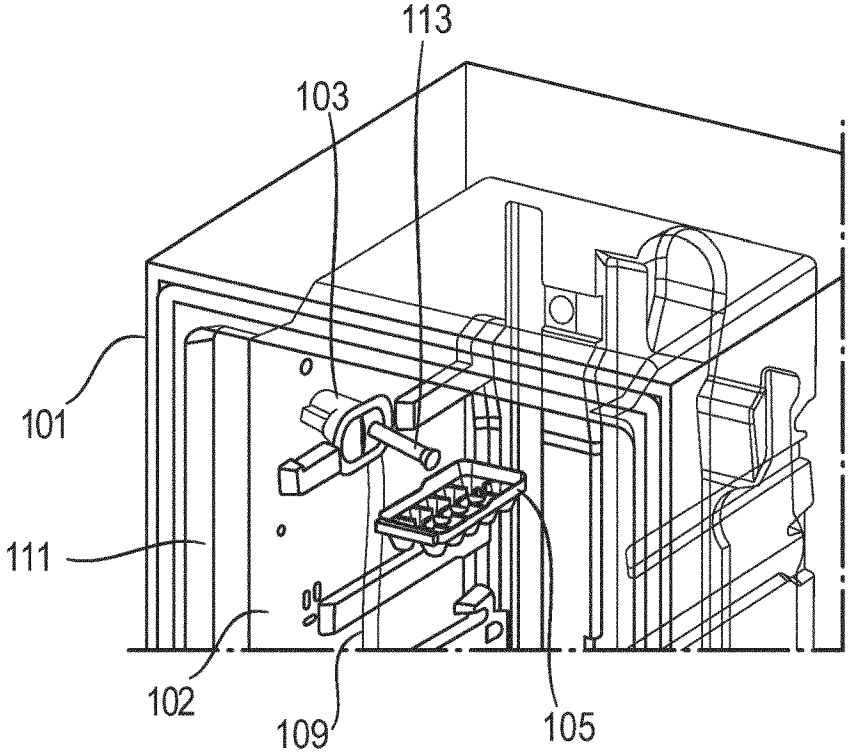
Fig. 1
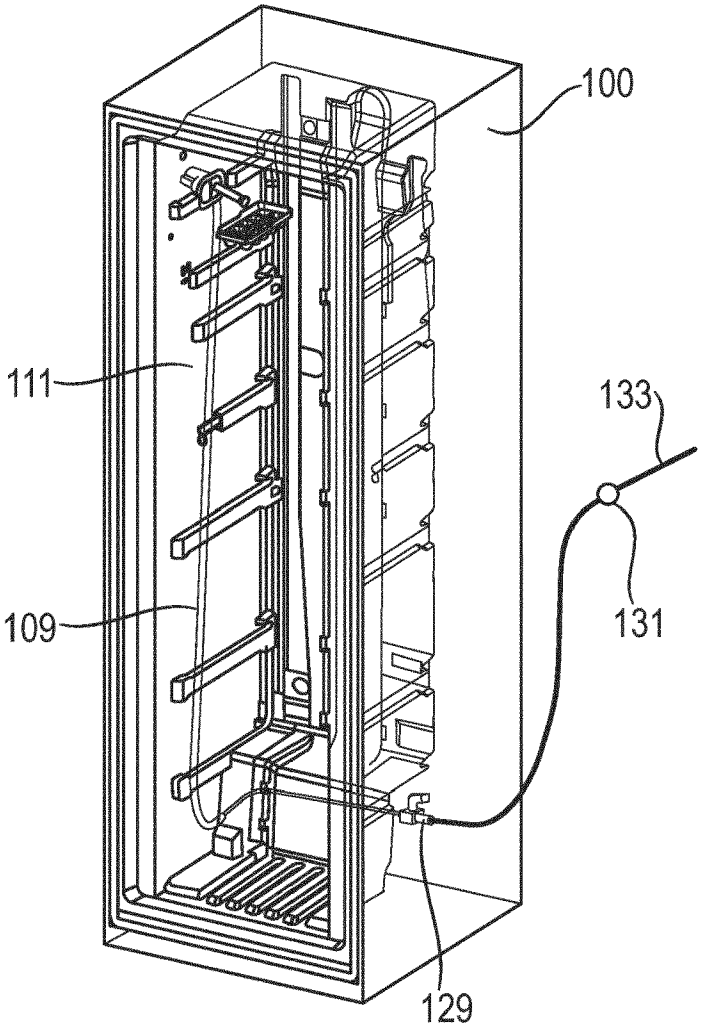

REFRIGERATION DEVICE HAVING AN ICE MAKER

The present invention relates to a refrigeration device comprising a water supply device for an ice maker.

BACKGROUND OF THE INVENTION

Field of the Invention

A water supply device for an ice maker is routed during installation from outside through a wall of the refrigeration device into the interior of a refrigeration device. For this purpose the wall of the refrigeration device has a through opening which is occupied by the water supply device. The through-opening can be disposed in such cases in a rear wall or a roof of the refrigeration device and can be covered by a lid after the installation of the water supply device. The water supply device now leads into the interior of the refrigeration device and to an ice maker.

BRIEF SUMMARY OF THE INVENTION

The underlying object of the invention is to specify a refrigeration device with improved fastening options for a water supply device.

This object is achieved by subject matter with the features as claimed in the independent claim. Advantageous embodiments of the invention are the subject matter of the figures, the description and the dependent claims.

In accordance with one aspect of the invention the object is achieved by a refrigeration device with a water supply device for supplying water to an ice maker, in which the refrigeration device has an installation recess closed towards an outer wall of the refrigeration device in an inner wall of the refrigeration device for inserting the water supply device into the interior of the refrigeration device.

The technical advantage achieved by the installation recess closed to the outside in the inner wall of the refrigeration device is that a through opening through a device wall can be dispensed with and less weakening of the insulation of the device wall is achieved. In addition a cover, such as a lid for example at the location of the water supply device on the opposite side from outside can be dispensed with. Positioning of the water supply device is also possible behind visible surfaces. Installation and removal of the water supply device can be done through the interior of the device, so that the refrigeration device can remain built into kitchen furniture during customer service.

A refrigeration device is especially understood as a household refrigeration device, i.e. a refrigeration device which is employed for household management in households or in the gastronomy field, and is used in particular to store foodstuffs and/or drinks at specific temperatures, such as for example a refrigerator, a freezer, a fridge/freezer combination, a chest freezer or a wine cooler.

In an advantageous form of embodiment of the refrigeration device the installation recess includes a receiving housing for insertion of the water supply device. The technical advantage achieved by this is that installation of the water supply device is simplified.

In a further advantageous form of embodiment of the refrigeration device the receiving housing is enclosed by foam in a wall of the refrigeration device. The technical advantage achieved by this for example is that the receiving housing is fixed in foam and thermal insulation of the receiving housing is achieved.

In a further advantageous form of embodiment of the refrigeration device the receiving housing has a connecting piece onto which an empty pipe can be pushed. The technical advantage achieved by this for example is that an empty pipe for routing a water line can be coupled to the receiving housing.

In a further advantageous form of embodiment of the refrigeration device the receiving housing has latching elements for fastening the receiving housing to the inner wall of the refrigeration device. The technical advantage achieved by this for example is that the production process is simplified, since the receiving housing can be latched and fixed rapidly.

In a further advantageous form of embodiment of the refrigeration device the receiving housing includes an electrical plug connection for electrical connection of the water supply device. The technical advantage achieved by this for example is that electrical contact for the water supply device can be established at the same time as the water supply device is inserted.

In a further advantageous form of embodiment of the refrigeration device the water supply includes a fastening tab for fastening the water supply device in the receiving housing. The technical advantage achieved by this for example is that the water supply device can be inserted and installed in a simple manner In a further advantageous form of embodiment of the refrigeration device the fastening tab includes latching hooks for latching into the receiving housing. The technical advantage achieved by this is likewise that installation of the water supply device is simplified still further.

In a further advantageous form of embodiment of the refrigeration device the water supply device has insulation for thermal insulation of the water supply device in relation to the receiving housing. The technical advantage achieved by this for example is that heat is not transferred from the water supply device to the refrigeration device.

In a further advantageous form of embodiment of the refrigeration device the insulation seals against the inner walls of the receiving housing. The technical advantage achieved by this for example is that no moist outside air gets into the interior of a freezer compartment and leads there to the formation of condensation and frost.

In a further advantageous form of embodiment of the refrigeration device the water supply device includes an electrical heater for heating a filler pipe. The technical advantage achieved by this for example is that ice forming inside the filler pipe can be dissolved.

In a further advantageous form of embodiment of the refrigeration device the electrical heater is disposed between two layers of thermally-conducting foil on the filler pipe. The technical advantage achieved by this for example is that a distribution of heat along the filler pipe is supported.

In a further advantageous form of embodiment of the refrigeration device the electrical heater is a cord heater or a foil heater. The technical advantage achieved by this for example is that particularly suitable and efficient heaters are used.

In a further advantageous form of embodiment of the refrigeration device the filler pipe has a water-repelling surface. The technical advantage achieved by this for example is that water flows completely out of the filler pipe and formation of ice in the filler pipe is avoided.

In a further advantageous form of embodiment of the refrigeration device the filler pipe has a trumpet-shaped outlet. The technical advantage achieved by this for example is that the water is guided in the trumpet shaped outlet and flows out without residues.

BRIEF DESCRIPTION OF THE SEVERAL VIEWS OF THE DRAWING

Exemplary embodiments of the invention are shown in the drawings and are described in greater detail below.

In the figures:

FIG. 1 shows a perspective view of a refrigeration device with a water supply device;

DESCRIPTION OF THE INVENTION

Figure 2:
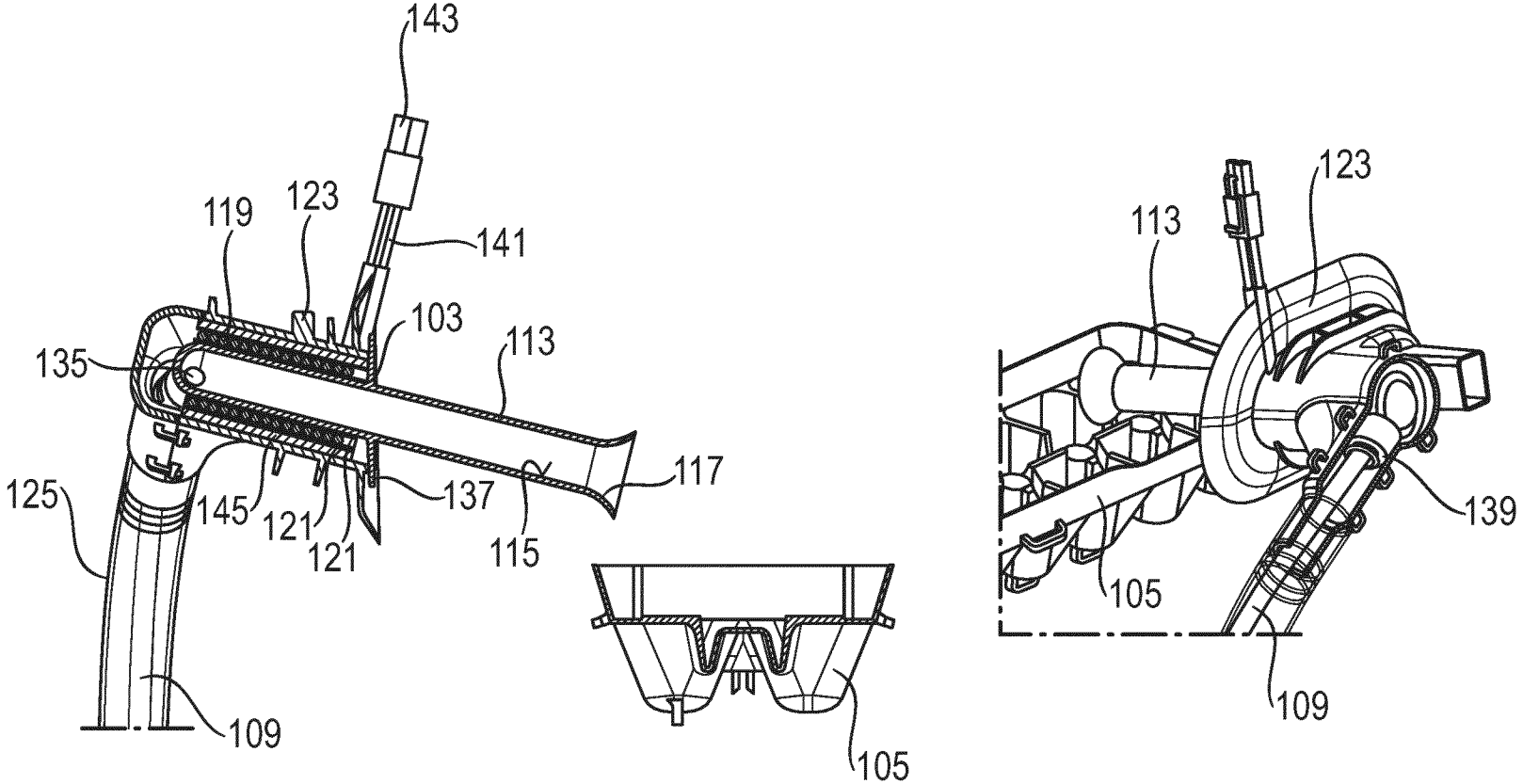
FIG. 2 shows an enlarged view of the water supply device.

FIG. 1 shows a refrigerator representing a refrigeration device 100. The refrigeration device 100 is used for example for cooling foodstuffs and comprises a coolant circuit with an evaporator, a compressor, a condenser and a choke element. The evaporator is a heat exchanger in which, after expansion, the fluid coolant is evaporated by taking up heat from the medium to be cooled, i.e. the air in the interior of the refrigerator.

The compressor is a mechanically-operated component which sucks out refrigerant vapor from the evaporator and expels it at high pressure to the condenser. The condenser is a heat exchanger in which, after compression, the heated coolant is liquefied by emitting heat to an external cooling medium, i.e. the surrounding air. The choke element is a facility for constantly reducing the pressure by cross-sectional constriction.

The coolant is a fluid which is used for heat transfer in the refrigerating system which, at low temperatures and low pressure of the fluid, takes up heat and at high temperature and higher pressure of the fluid emits heat, wherein this usually includes changes to the state of the fluid.

Disposed in the interior of the refrigeration device 100 is an ice maker for creation of ice from water 105. A water supply device 103 is used for filling the ice maker 105 in the refrigeration device 100 and is inserted in a non-penetrating manner into a wall 111 of the refrigeration device 100 and is fastened to the wall 111. The wall 111 comprises an outer wall 101 on the outer side of the refrigeration device 100 and an inner wall 102 in the interior of the refrigeration device 100. The water supply device 103 is disposed to the side of the ice maker 105.

The water supply device 103 is built into the side wall 111 of the refrigeration device 100 and is positioned above an ice maker 105. Connected to the water supply device 103 is a water line 109. The water line 109 runs inside the wall 111 of the refrigeration device and at least partly in parallel to the outer wall 101 or inner wall 102 of the wall 111. The water supply device 103 has a corresponding connection for the water line 109. The ice maker 105 is filled via the water supply device 103 and the water can freeze into ice in the ice maker 105.

The water flow is opened and closed by an electrically-operated water valve 129. The water valve 129 is connected via a flexible connecting water line 131 to an external water supply 133. The electric water valve 129 is disposed in a machinery compartment of the refrigeration device 100. From the water valve 129, the water line 109 at leads to the water supply device 103 which can be enclosed in the foam of the refrigeration device 100 or can run in a foamed-in empty pipe. Through the opening of the water valve 129 a water flow through the water line 109 to the water supply device 103 is switched. The water supply device 103 therefore does not need any penetrative installation access through the wall 111 of the refrigeration device.

FIG. 2 shows an enlarged view of the water supply device 103. The water supply device 103 comprises a filler pipe 113 having an inlet 135, and an outlet 117 and a fastening tab 137. Integrated into the inlet of the water supply device 103 is a so-called fast-fit connector 139, which is used for watertight connection of the water line 109.

The entire inner surface 115 of the filler pipe 113 is designed to be especially smooth or water-repelling in order to guarantee that water flows out of the filler pipe 113 without residues and to prevent the water supply device 103 freezing up. The outlet 117 of the water supply device 103 is designed in the shape of the trumpet. This supports the outflow of water without residues, especially in the area of the outlet 117. The water supply device 103 is also equipped with an electric heater 119. The electric heater 119 has a cord heater as its heating element which is provided with corresponding electrical lines 141 and an electrical plug connector 143. The electrical plug connector 143 is designed as conventional plug contact.

The electric heater 119 is wound between the layers of thermally-conducting foil 121, for example aluminum foil, onto the filler pipe 113. The two layers of the foil 121 support the distribution of heat along the filler pipe.

The electric heater 119 is provided with insulation 145. The insulation 145 has the function of thermal insulation through which the heat of the heater is concentrated on the filler pipe 113 and is emitted inwards. The insulation 145 also fulfils a sealing function after installation in a corresponding receiving housing 123 through which moist outside air is prevented from getting into the inside of the freezer compartment and leading to the formation of condensation and frost there.

The filler pipe 113 has a fastening tab 137 which is used for fastening the filler pipe 113 into the receiving housing 123. The fastening tab 137 includes latching hooks which a latch into corresponding undercuts in the receiving housing 123 and fix the water supply device 103 in its final position in relation to the ice maker 105.

Figure 3:
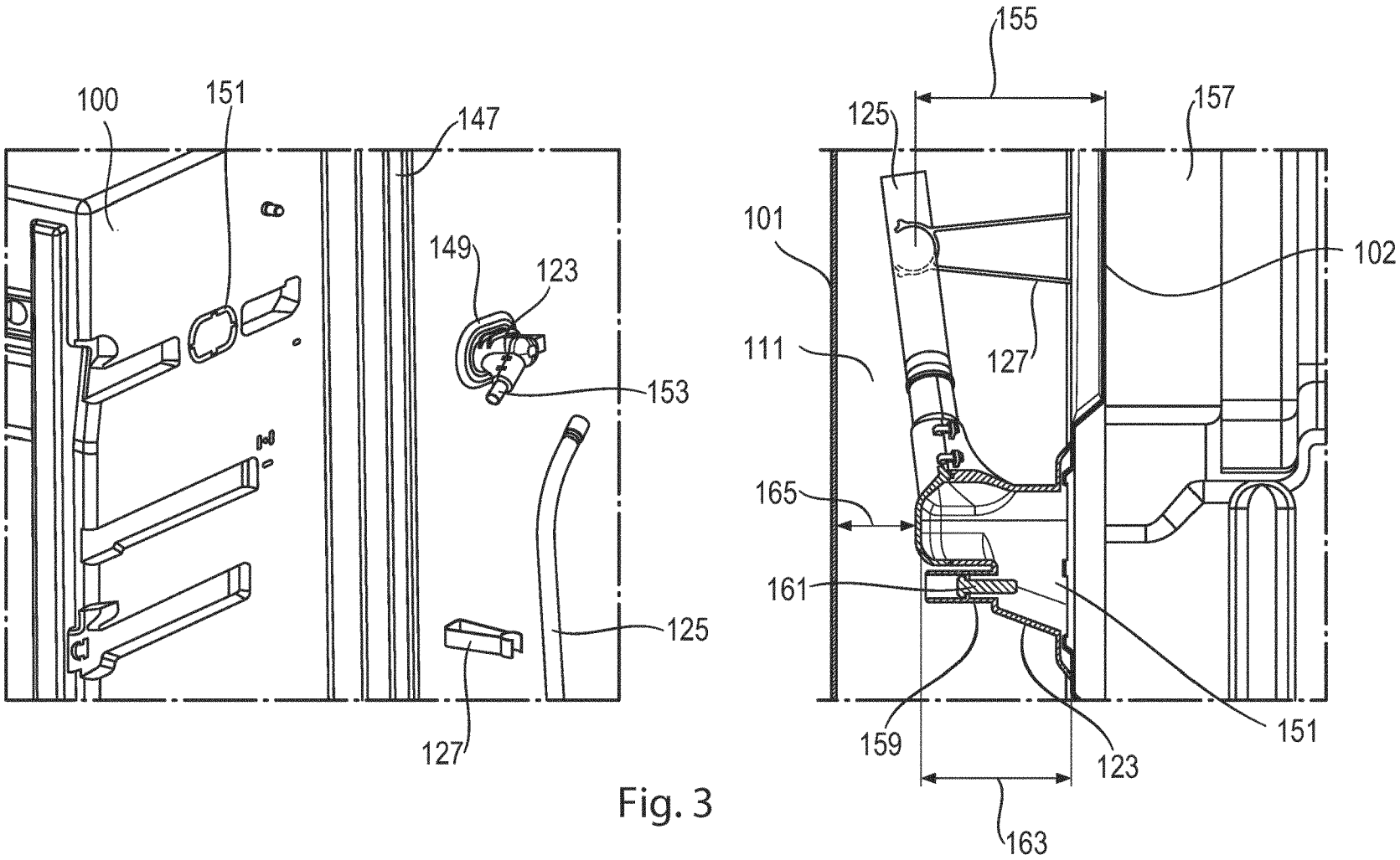
FIG. 3 shows a view of a receiving housing of the water supply device in conjunction with an inner container wall.

FIG. 3 shows a view of a receiving housing 123 of the water supply device 103 in conjunction with inner container wall 147. The receiving housing 123 forms a space and a fastening option for the water supply device 103. The receiving housing 123 is built into an inner container before a foaming process.

To this end the receiving housing 123 has latching or fastening elements 149 which are latched into the corresponding installation recess 151 of the inner container. At the other end the receiving housing 123 possesses a connection piece 153, which is designed to have an empty pipe 125 pushed onto it and fastened. The empty pipe 125 is likewise installed before a foaming process and is used to lay the water line 109 in the refrigeration device 100 and to dismantle said line easily if necessary.

The empty pipe 125 runs in the foam of the wall 111 between the outer wall 101 and the inner wall 102 at a suitable distance 155 from a freezer compartment 157, in order to avoid the water in the water line 109 which runs in the empty pipe 125 freezing. The distance 155 is guaranteed by corresponding distance pieces 127 which are distributed over the entire length of the empty pipe 125. The receiving housing 123 has an integrated fastening device 159 for an electrical plug 161. The electrical plug 161 is likewise fastened in the receiving housing 123 before the foaming process and is used later for contacting the electric heater 119 of the water supply device 103.

The depth 163 of the receiving housing 123 is dimensioned so that the remaining insulation thickness 165 is always still sufficient to guarantee effective insulation at this point. The outer wall 101 is formed continuously and without an opening at the position of the installation recess 151.

Figure 4:
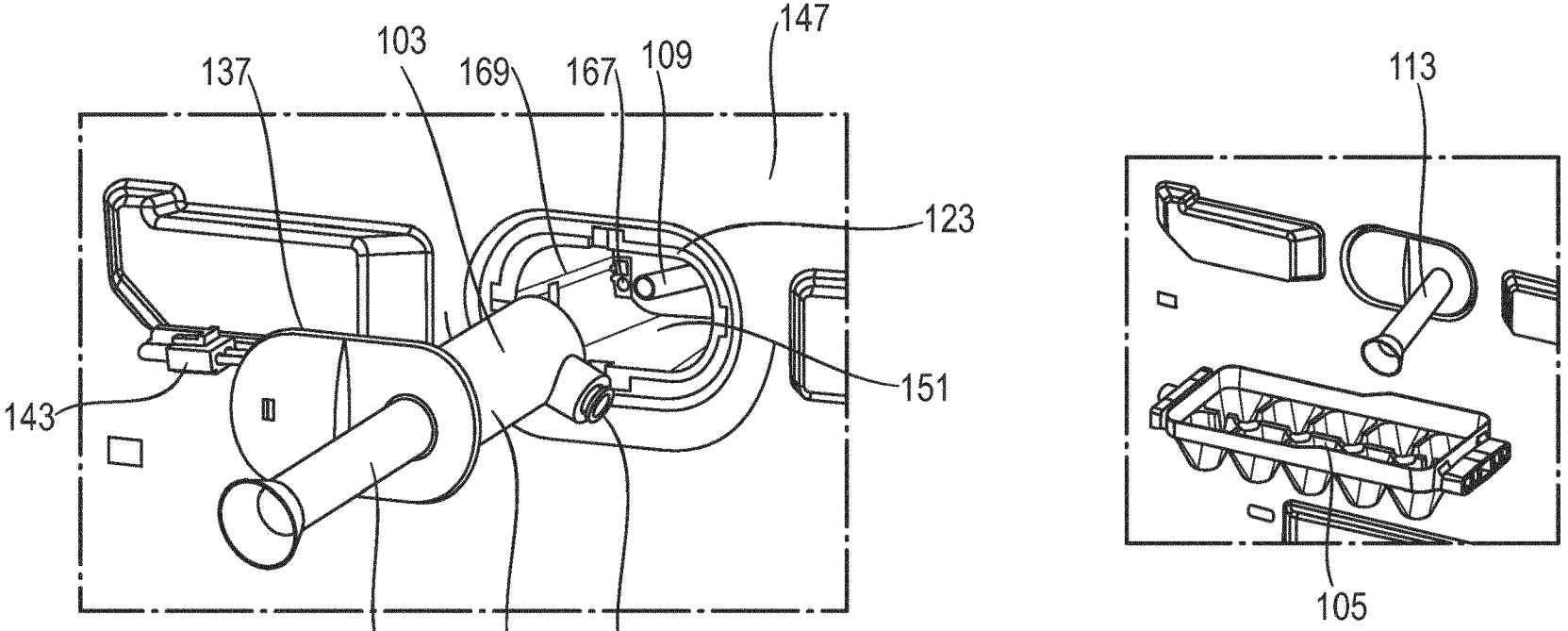
FIG. 4 shows a further view of the water supply device in conjunction with the inner container wall and FIG. 5 shows an overhead view of the water supply device in conjunction with the ice maker.

FIG. 4 shows a further view of the water supply device 103, in conjunction with the inner container wall 147, during an installation and fastening of the water supply device 103 in the receiving housing 123. For the installation of the water supply device 123 in the receiving housing 123, first of all the water line 109 is connected into the inlet 177 of the water supply device 103 and the electrical plug-in connector 143 of the heater 119 is contacted with the pre-installed plug 167 in the receiving housing 123.

Then the water supply device 103 is pushed into the receiving housing 123. The water line 109 is pushed in this case into the foamed-in empty pipe 125. The electrical lines 169 are placed within the receiving housing 123. After the water supply device 103 is pushed into the receiving housing 123 the insulation 145 forms a seal against the inner walls of the receiving housing 123.

Latching hooks are disposed in the fastening tab 137, which latch in the receiving housing 123. The fastening tab 137 completely covers the receiving housing 123 after installation of the water supply device 103.

Figure 5:
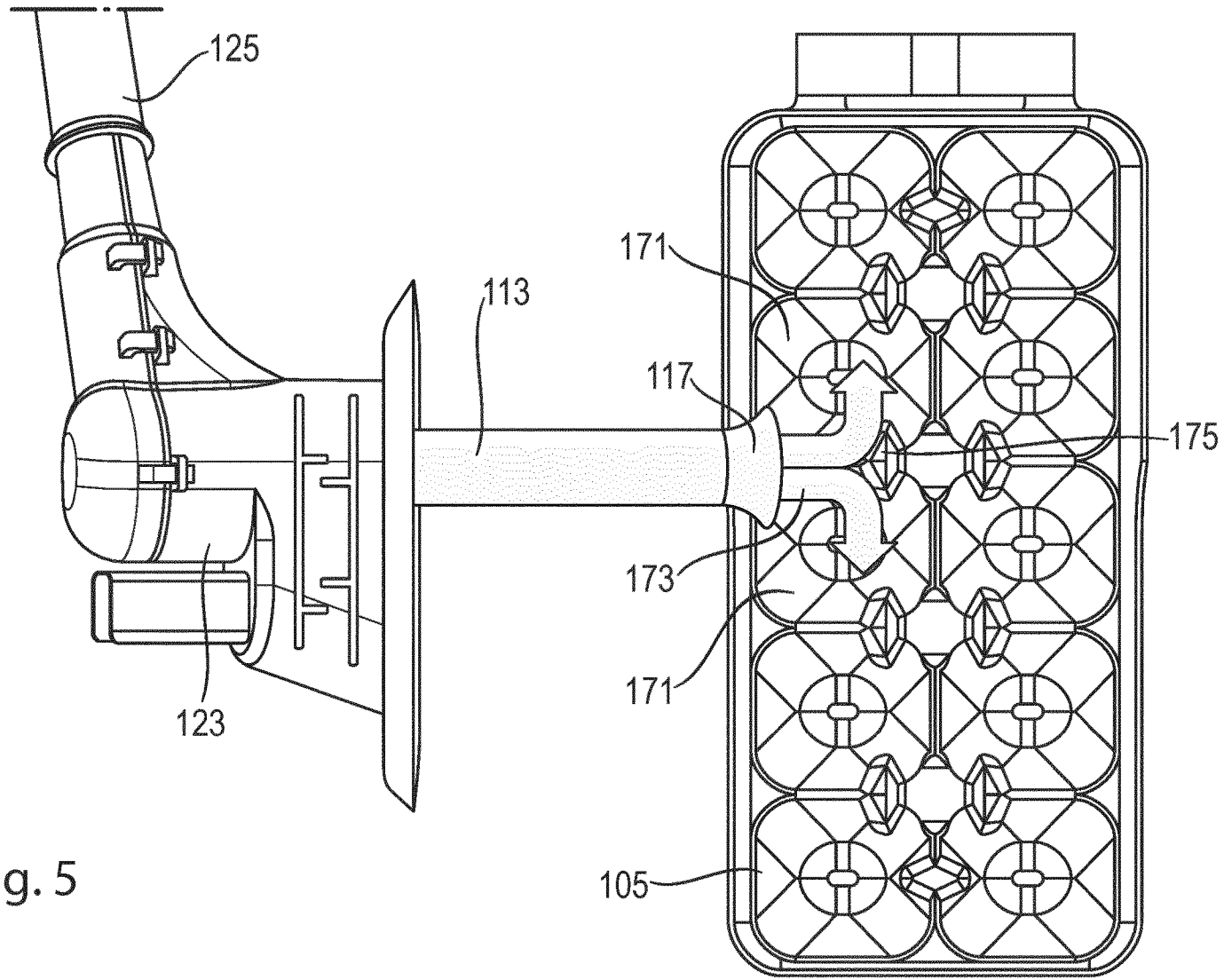

FIG. 5 shows an overhead view of the water supply device 103 in conjunction with the ice maker 105 as well as its position relative to the ice maker 105. After the installation of the water supply device 103 the outlet 117 has a particular position relative to the ice maker 105. The outlet 117 of the water supply device 103 lies in this case between two cavities 171 of the ice maker 105, so that the outflowing jet of water 173 strikes the web 175 between the two cavities 171. When this occurs the water jet 173 is divided and calmed in its flow and thus makes it possible to fill the ice maker 105 without any splashing.

In general the fastening of the receiving housing 123 to the inner container wall 147 can also be designed as a screw or glued connection. The electric heater 119 can be designed as a foil heater. The water line 109 can be connected to the water supply device 103 by a connector other than a fast-fit connector 139, such as a screw connection, clamp connection, welded or glued connection for example. The water supply device 103 can be fastened by a fastening other than one that latches it into the receiving housing 123, for example by a screw fastening.

In general the advantages achieved by the invention are that no continuous installation recess is made through a device wall and the insulation of the device wall is weakened less than occurs with a continuous installation recess. There is no cover on the opposite side of the water supply device from an outer side. It is also possible to position the water supply device behind see-through surfaces. Installation and dismantling is undertaken through the interior of the device and the refrigeration device can be left built into kitchen furniture during customer service. Installation in the side wall means that it is not necessary to penetrate the rear wall or roof of the refrigeration device, which is of particular advantage for a no-frost device.

All features explained and shown in conjunction with individual forms of embodiment of the invention can be provided in different combinations in the inventive subject matter in order to simultaneously realize their advantageous effects.

The scope of protection of the present invention is given by the claims and is not restricted by the features explained in the description or shown in the figures.

LIST OF REFERENCE CHARACTERS

| | |
|---|---|
| 100 | Refrigeration device |
| 101 | Outer wall |
| 102 | Inner wall |
| 103 | Water supply device |
| 105 | Ice maker |
| 107 | Water connection |
| 109 | Water line |
| 111 | Wall |
| 113 | Filler pipe |
| 115 | Surface |
| 117 | Outlet |
| 119 | Heater |
| 121 | Conductive foil |
| 123 | Receiving housing |
| 125 | Empty pipe |
| 127 | Distance piece |
| 129 | Water valve |
| 131 | Connecting water line |
| 133 | Water supply |
| 135 | Inlet |
| 137 | Fastening tab |
| 139 | Fast-fit connector |
| 141 | Electrical lines |
| 143 | Electrical plug connector |
| 145 | Insulation |
| 147 | Inner container wall |
| 149 | Latching elements |
| 151 | Installation recess |
| 153 | Connection piece |
| 155 | Distance |
| 157 | Refrigerator compartment |
| 159 | Fastening device |
| 161 | Electrical plug |
| 163 | Depth |
| 165 | Remaining insulation thickness |
| 167 | Plug connector |
| 169 | Free space |
| 171 | Cavity |
| 173 | Water jet |
| 175 | Web |
| 177 | Inlet |

The invention claimed is:

1. A refrigeration device, comprising:

an ice maker;

a water supply device for supplying water to said ice maker, said water supply device having an electric heater;

an outer refrigeration device wall;

an inner refrigeration device wall defining a refrigeration device interior;

said inner refrigeration device wall having an installation recess formed therein for insertion of said water supply device in said refrigeration device interior;

said installation recess including a receiving housing for insertion of said water supply device, said receiving housing being disposed between said outer refrigeration device wall and said inner refrigeration device wall, said receiving housing having an integrated fastening device with an electrical heater plug fastened therein, said electrical heater plug being configured for contacting said electric heater, and said receiving housing with said fastening device and said heater plug being enclosed by foam in said inner refrigeration device wall;

said installation recess being disposed at a position of said outer refrigeration device wall and said installation recess being closed towards said outer refrigeration device wall; and said outer refrigeration device wall being formed without an opening at said position of said installation recess.

2. The refrigeration device according to claim 1, wherein said receiving housing is foamed into a refrigeration device wall.

3. The refrigeration device according to claim 1, wherein said receiving housing includes latches for fastening said receiving housing to said inner refrigeration device wall.

4. The refrigeration device according to claim 1, wherein said receiving housing includes an electrical plug connector for electrical connection of said water supply device.

5. The refrigeration device according to claim 1, wherein said water supply device has a fastening tab for fastening said water supply device in said receiving housing.

6. The refrigeration device according to claim 1, wherein said water supply device includes a filler pipe and said electric heater is configured to heat said filler pipe.

7. The refrigeration device according to claim 6, which further comprises two layers of thermally-conducting foil disposed on said filler pipe, said electric heater being disposed between said two layers of thermally-conducting foil.

8. The refrigeration device according to claim 6, wherein said electric heater is a cord heater or a foil heater.

9. The refrigeration device according to claim 6, wherein said filler pipe has a water-repelling surface.

10. The refrigeration device according to claim 6, wherein said filler pipe has a trumpet-shaped outlet.

11. A refrigeration device, comprising:

an ice maker;

a water supply device for supplying water to said ice maker, said water supply device having an electric heater;

an outer refrigeration device wall;

an inner refrigeration device wall defining a refrigeration device interior;

said inner refrigeration device wall having an installation recess formed therein for insertion of said water supply device in said refrigeration device interior;

said installation recess including a receiving housing for insertion of said water supply device, said receiving housing being disposed between said outer refrigeration device wall and said inner refrigeration device wall, said receiving housing having an integrated fastening device with an electrical heater plug fastened therein, said electrical heater plug being configured for contacting said electric heater, and said receiving housing with said fastening device and said heater plug being enclosed by foam in said inner refrigeration device wall;

said installation recess being disposed at a position of said outer refrigeration device wall and said installation recess being closed towards said outer refrigeration device wall;

said outer refrigeration device wall being formed without an opening at said position of said installation recess; and an empty pipe, said receiving housing including a connection piece, and said empty pipe being configured to be pushed into said connection piece.

12. A refrigeration device, comprising:

an ice maker;

a water supply device for supplying water to said ice maker, said water supply device having an electric heater;

an outer refrigeration device wall;

an inner refrigeration device wall defining a refrigeration device interior;

said inner refrigeration device wall having an installation recess formed therein for insertion of said water supply device in said refrigeration device interior;

said installation recess including a receiving housing for insertion of said water supply device, said receiving housing being disposed between said outer refrigeration device wall and said inner refrigeration device wall, said receiving housing having an integrated fastening device with an electrical heater plug fastened therein, said electrical heater plug being configured for contacting said electric heater, and said receiving housing with said fastening device and said heater plug being enclosed by foam in said inner refrigeration device wall;

said water supply device having insulation for thermally insulating said water supply device relative to said receiving housing;

said installation recess being disposed at a position of said outer refrigeration device wall and said installation recess being closed towards said outer refrigeration device wall; and said outer refrigeration device wall being formed without an opening at said position of said installation recess.

13. The refrigeration device according to claim 12, wherein said receiving housing has inner walls, and said insulation forms a seal against said inner walls of said receiving housing.

* * * * *